United States Patent [19]

Gregory et al.

[11] Patent Number: 4,859,651

[45] Date of Patent: Aug. 22, 1989

[54] THERMAL TRANSFER PRINTING

[75] Inventors: Peter Gregory, Bolton; Roy Bradbury, Farnworth; Barry H. Meyrick, Flixton, all of England

[73] Assignee: Imperial Chemical Industries PLC, London, United Kingdom

[21] Appl. No.: 227,990

[22] Filed: Aug. 3, 1988

[30] Foreign Application Priority Data

Aug. 4, 1987 [GB] United Kingdom ..... 8718431

[51] Int. Cl.[4] ..... B41M 5/35; B41M 5/26

[52] U.S. Cl. ..... 503/227; 8/471; 427/256; 427/261; 428/195; 428/913; 428/914

[58] Field of Search ..... 8/471; 428/195, 913, 428/914; 503/227; 427/256, 261

[56] References Cited

U.S. PATENT DOCUMENTS

| | | | |
|---|---|---|---|
| 4,614,521 | 9/1986 | Niwa et al. | 430/964 |
| 4,668,775 | 5/1987 | Bergmann et al. | 534/765 |

FOREIGN PATENT DOCUMENTS

| | | | |
|---|---|---|---|
| 0111004 | 6/1984 | European Pat. Off. | 503/227 |
| 0133011 | 2/1985 | European Pat. Off. | 503/227 |
| 0133012 | 2/1985 | European Pat. Off. | 503/227 |

*Primary Examiner*—Bruce H. Hess

*Attorney, Agent, or Firm*—Cushman, Darby and Cushman

[57] ABSTRACT

A thermal transfer printing sheet, suitable for use in a thermal transfer printing process, comprising a substrate having a coating comprising a water-insoluble dye of the formula:

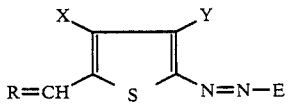

wherein

R represents the residue of an active methylene compound;

X represents hydrogen, halogen or an optionally substituted alkyl, aryl or heteroaryl radical;

Y represents cyano, nitro, alkanoyl, aroyl, alkylsulphonyl, arylsulphonyl or a group of the formula —$COOR^1$ or —$CONR^2R^3$ wherein $R^1$ represents a hydrocarbyl radical and each of $R^2$ and $R^3$, independently, represents hydrogen or a hydrocarbyl radical; and E represents the residue of a coupling component.

7 Claims, No Drawings

THERMAL TRANSFER PRINTING

INTRODUCTION

This specification describes an invention relating to thermal transfer printing (TTP), especially to a TTP sheet carrying a dye or dye mixture, and to a transfer printing process in which the dye is transferred from the transfer sheet to a receiver sheet by the application of heat.

In TTP a heat-transferable dye is applied to a sheet-like substrate in the form of an ink, usually containing a polymeric or resinous binder to bind the dye to the substrate, to form a transfer sheet. This is then placed in contact with the material to be printed, (generally a film of polymeric material such as a polyester sheet) hereinafter called the receiver sheet and selectively heated in accordance with a pattern information signal whereby dye from the selectively heated regions of the transfer sheet is transferred to the receiver sheet and forms a pattern thereon in accordance with the pattern of heat applied to the transfer sheet.

Important criteria in the selection of a dye for TTP are its thermal properties, brightness of shade, fastness properties, such as light fastness, and facility for application to the substrate in the preparation of the transfer sheet. For suitable performance the dye should transfer evenly, in proportion to the heat applied to the TTP sheet so that the depth of shade on the receiver sheet is proportional to the heat applied and a true grey scale of coloration can be achieved on the receiver sheet. Brightness of shade is important in order to achieve as wide a range of shades with the three primary dye shades of yellow, magenta and cyan. As the dye must be sufficiently mobile to migrate from the transfer sheet to the receiver sheet at the temperatures employed, 300°–400° C., it is generally free from ionic and water-solubilising groups, and is thus not readily soluble in aqueous or water-miscible media, such as water and ethanol. Many suitable dyes are also not readily soluble in the hydrocarbon solvents which are commonly used in, and thus acceptable to, the printing industry; for example, alcohols such as i-propanol, ketones such as methyl-ethylketone (MEK), methyl-i-butylketone (MIBK) and cyclohexanone and aromatic hydrocarbons such as toluene. Although the dye can be applied as a dispersion in a suitable solvent, it has been found that brighter, glossier and smoother final prints can be achieved on the receiver sheet if the dye is applied to the substrate from a solution. In order to achieve the potential for a deep shade on the receiver sheet it is desirable that the dye should be readily soluble in the ink medium. It is also important that a dye which has been applied to a transfer sheet from a solution should be resistant to crystallisation so that it remains as an amorphous layer on the transfer sheet for a considerable time.

The following combination of properties are highly desirable for a dye which is to be used in TTP:

Ideal spectral characteristics (narrow absorption curve with absorption maximum matching a photographic filter).

High tinctorial strength (extinction coefficient >40,000).

Correct thermochemical properties (high thermal stability and good transferability with heat).

High optical densities on printing.

Good solubility in solvents acceptable to printing industry: this is desirable to produce solution coated dyesheets.

Stable dyesheets (resistant to dye migration or crystallisation).

Stable printed images on the receiver sheet (to heat and especially light).

The achievement of good light fastness in TTP is extremely difficult because of the unfavourable environment of the dye, namely surface printed polyester on a white pigmented base. Many known dyes for polyester fibre with high light fastness (>6 on the International Scale of 1–8) on polyester fibre exhibit very poor light fastness (<3) in TTP.

It has now been found that certain monoazo dyes derived from aminothiophenes provide desirable cyan shades having high light fastness and good optical density and are thermally stable.

THE INVENTION

According to a first aspect of the present invention there is provided a thermal transfer printing sheet comprising a substrate having a coating comprising a water-insoluble dye of the formula:

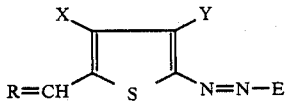

I wherein

R represents the residue of an active methylene compound;

X represents hydrogen, halogen or an optionally substituted alkyl, aryl or heteroaryl radical;

Y represents cyano, nitro, alkanoyl, aroyl, alkylsulphonyl, arylsulphonyl or a group of the formula —$COOR^1$ or —$CONR^2R^3$ wherein $R^1$ represents a hydrocarbyl radical and each of $R^2$ and $R^3$, independently, represents hydrogen or a hydrocarbyl radical, and E represents the residue of a coupling component.

THE COATING

The coating preferably comprises a binder and one or more dyes of Formula I. The ratio of binder to dye is preferably at least 1:1 and more preferably from 1.5:1 to 4:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

THE BINDER

The binder may be any resinous or polymeric material suitable for binding the dye to the substrate which has acceptable solubility in the ink medium, i.e. the medium in which the dye and binder are applied to the transfer sheet. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone;

polymers and co-polymers derived from acrylates and acrylate derivatives, such as polyacrylic acid, polymethyl methacrylate and styrene-acrylate colpolymers, polyester resins, polyamide resins, such as melamines; polyurea and polyurethane resins; organosilicones, such as polysiloxanes, epoxy resins and natural resins, such as gum tragacanth and gum arabic.

It is however preferred to use a binder which is soluble in one of the above-mentioned commercially acceptable organic solvents. Preferred binders of this type are EHEC, particularly the low and extra-low viscosity grades, and ethyl cellulose.

THE DYE OF FORMULA I

Dyes of Formula I and methods for their preparation are described in German Offenlegungsschrift 3427200 where they are proposed as dyes for textile fibres, especially polyester textiles.

For a more detailed description of the residues R and E and the radicals X and Y present in the dyes of Formula I, reference is made to the above mentioned Offenlegungschrift.

Preferred dyes of Formula I have one or more of the following characteristics:

(1) R is a group of the formula:

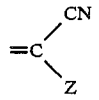

II wherein Z represents CN or a group of the formula —COOT wherein T is $C_{1-4}$-alkyl;

(2) X is hydrogen or chlorine;

(3) Y is cyano or nitro;

(4) E is a radical of the formula:

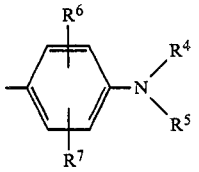

III wherein $R^4$ represents hydrogen or $R^5$, $R^5$ represents an optionally substituted alkyl, cycloalkyl, alkyenyl, aralkyl or aryl radical, especially $C_{1-4}$-alkyl or $C_{1-4}$-alkylcarbonyloxyethyl, and $R^6$ & $R^7$ each independently represents hydrogen, halogen, alkyl, alkoxy, alkylsulphonylamino or alkylcarbonylamino.

It is preferred that $R^6$ is hydrogen and $R^7$ is $C_{1-4}$-alkyl or $C_{1-4}$-alkylcarbonylamino.

The dye of Formula I has particularly good thermal properties giving rise to even prints on the receiver sheet, whose depth of shade is accurately proportional to the quantity of applied heat so that a true grey scale of coloration can be attained.

The dye of Formula I also has strong coloristic properties and good solubility in a wide range of solvents, especially those solvents which are widely used and accepted in the printing industry, for example, alkanols, such as i-propanol & butanol; aromatic hydrocarbons, such as toluene, and ketones such as MEK, MIBK and cyclohexanone. This produces inks (solvent plus dye and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The recevier sheets according to the present invention have bright, strong and even cyan shades which are fast to both light and heat.

THE SUBSTRATE

The substrate may be any convenient sheet material capable of withstanding the temperatures involved in TTP, up to 400° C. over a period of up to 20 milliseconds (msec) yet thin enough to transmit heat applied on one side through to the dye on the other side to effect transfer to a receiver sheet within such short periods, typically from 1–10 msec. Examples of suitable materials are paper, especially high quality paper of even thickness, such as capacitor paper, polyester, polacrylate, polyamide, cellulosic and polyalkylene films, metallised forms thereof, including co-polymer and laminated films, especially laminates incorporating a polyester receptor layer on which the dye is deposited. Such laminates preferably comprise, a backcoat, on the opposite side of the laminate from the receptor layer, of a heat resistant material, such as a thermoseting resin, e.g a silicone, acrylate or polyurethane resin, to separate the heat source from the polyester and prevent melting of the latter during the thermal transfer printing operation. The thickness of the substrate may vary within wide limits depending upon its thermal characteristics but is preferably less than 50 μm and more preferably below 10 μm.

THE TTP PROCESS

According to a further feature of the present invention there is provided a transfer printing process which comprises contacting a transfer sheet coated with a dye of Formula I with a receiver sheet, so that the dye is in contact with the receiver sheet and selectively heating areas of the transfer sheet whereby dye in the heated areas of the transfer sheet may be selectively transferred to the receiver sheet.

The transfer sheet is preferably heated to a temperature from 250° C. to 400° C., more preferably above 300° C. and especially around 350° C., for a period of from 1 to 10 milliseconds while it is maintained with the coating in contact with the receiver sheet. The depth of shade of print on any area of the receiver sheet will vary with the time period for which the transfer sheet is heated while in contact with that area of the receiver sheet.

THE RECEIVER SHEET

The receiver sheet conveniently comprises a polyester sheet material, especially a white polyester film, preferably of polyethylene terephthalate (PET). Although some dyes of Formula I are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye is applied, into which the dye more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the dyes of Formula I give particularly strong and good quality prints (e.g. fast to light, heat and storage) on any specific transfer or receiver sheet, compared with other dyes of similar structure which have been proposed for thermal transfer printing. The design of receiver and transfer sheets is discussed further in EP 133,011 and EP 133012.

The invention is further illustrated by the following examples in which all parts and percentages are by weight unless otherwise indicated.

EXAMPLE 1

Ink 1 was prepared by dissolving 0.1 g of Dye 1 in 5 ml of chloroform and adding 9.5 ml of a 2.7% solution of EHEC-elv in chloroform. The ink was stirred until homogeneous.

Dye 1 had the structure:

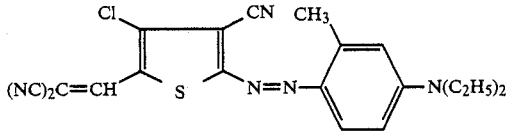

A transfer sheet was prepared by applying Ink 1 to a sheet of 6μ thick polyethylene terephthalate using a wire-wound metal Meyer-bar to produce a 24 micron wet film of ink on the surface of the sheet. The ink was dried with hot air and the sheet is hereinafter referred to as TS 1.

A sample of TS 1 was sandwiched with a receiver sheet, comprising a composite structure based on a white polyester base having a receptive coating layer on the side in contact with the printed surface of TS 1. The sandwich was placed on the drum of a transfer printing machine and passed over a matrix of closely-spaced pixels which were selectively heated in accordance with a pattern information signal to a temperature of >300° C. for periods from 2 to 10 msec, whereby a quantity of the dye, in proportion to the heating period, at the position on the transfer sheet in contact with a pixel while it was hot was transferred from the transfer sheet to the receiver sheet. After passage over the array of pixels the transfer sheet was separated from the receiver sheet. The printed receiver sheet is hereinafter referred to as RS 1.

The stability of the ink and the quality of the print on the transfer sheet was assessed by visual inspection. An ink was considered stable if there was no precipitation over a period of two weeks at ambient and a transfer sheet was considered stable if it remained substantially free from crystallisation for a similar period. The quality of the printed impression on the receiver sheet was assessed in respect of reflected colour density by means of a densitometer (Sakura Digital densitometer). The results of the assessments are set out below.

| | Optical Density | Light Fastness |
|---|---|---|
| RS 1 | 1.2 | 4 |

EXAMPLE 2

Further inks, transfer sheets and receiver sheets were made by the methods described in Example 1 using dyes of the formula:

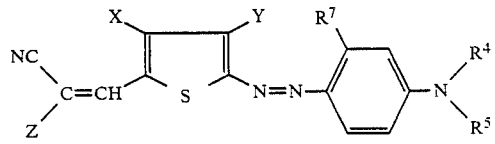

the dyes being identified by their substituents in the following Table which also gives measured values for the optical density (OD) and light fastness (LF) of each dye.

TABLE

| X | Y | Z | $R^4$ | $R^5$ | $R^7$ | OD | LF |
|---|---|---|---|---|---|---|---|
| Cl | CN | $C_2H_5OCO$ | $C_2H_5$ | $C_2H_5$ | $CH_3$ | 1.5 | 3–4 |
| Cl | CN | $C_2H_5OCO$ | $C_2H_5$ | $C_2H_5$ | $NHCOCH_3$ | 1.3 | 3–4 |
| H | CN | $C_2H_5OCO$ | $C_2H_5$ | n-$C_4H_9$ | $CH_3$ | 1.8 | 3–4 |
| H | $NO_2$ | $C_2H_5OCO$ | $C_2H_4OCOCH_3$ | $C_2H_4OCOCH_3$ | $CH_3$ | 1.3 | 3–4 |
| Cl | CN | n-$C_4H_9OCO$ | $C_2H_5$ | $C_2H_5$ | $NHCOCH_3$ | 1.2 | 3–4 |
| Cl | CN | t-$C_4H_9OCO$ | $C_2H_5$ | $C_2H_5$ | $NHCOCH_3$ | 1.2 | 3–4 |

We claim:

1. A thermal transfer printing sheet comprising a substrate having a coating comprising a binder and a water-insoluble dye of the formula:

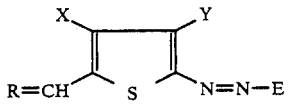

wherein

R represents the residue of an active methylene compound;

X represents hydrogen, halogen or an optionally substituted alkyl, aryl or heteroaryl radical;

Y represents cyano, nitro, alkanoyl, aroyl, alkylsulphonyl, arylsulphonyl or a group of the formula —$COOR^1$ or —$CONR^2R^3$ wherein $R^1$ represents a hydrocarbyl radical and each of $R^2$ and $R^3$, independently, represents hydrogen or a hydrocarbyl radical, and E represents the residue of a coupling component.

2. A thermal transfer printing sheet according to claim 1 wherein, in the dye, R is a group of the formula:

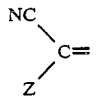

wherein Z represents —CN or a group of the formula —COOT in which T is $C_{1-4}$-alkyl.

3. A thermal transfer printing sheet according to claim 2 wherein, in the dye, X is hydrogen or chlorine.

4. A thermal transfer printing sheet according to claim 1 wherein, in the dye, X is hydrogen or chlorine.

5. A thermal transfer printing sheet according to claim 1 wherein, in the dye, E is a radical of the formula:

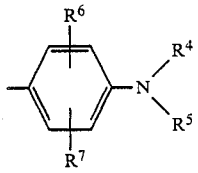

wherein $R^4$ represents hydrogen or $R^5$, $R^5$ represents an optionally substituted alkyl, cycloalkyl, alkenyl, aralkyl, or aryl radical, and $R^6$ & $R^7$ each independently represents hydrogen, halogen, alkyl, alkoxy, alkylsulphonylamino or alkylcarbonylamino.

6. A thermal transfer printing sheet according to claim 5 wherein each of $R^4$ and $R^5$ is $C_{1-4}$-alkyl or $C_{1-4}$-alkylcarbonyloxyethyl.

7. A thermal transfer printing sheet according to claim 6 wherein $R^6$ is hydrogen and $R^7$ is $C_{1-4}$-alkyl or $C_{1-4}$-alkylcarbonylamino.

8. A thermal transfer printing sheet according to claim 5 wherein $R^6$ is hydrogen and $R^7$ is $C_{1-4}$-alkyl or $C_{1-4}$-alkylcarbonylamino.

9. A thermal transfer printing process which comprises contacting a transfer sheet according to claim 1 with a receiver sheet, so that the dye is in contact with the receiver sheet and selectively heating areas of the transfer sheet whereby dye in the heated areas of the transfer sheet is selectively transferred to the receiver sheet.

* * * * *